US007465199B2

(12) United States Patent
Osada et al.

(10) Patent No.: US 7,465,199 B2
(45) Date of Patent: Dec. 16, 2008

(54) FEMALE TERMINAL

(75) Inventors: Takeshi Osada, Makinohara (JP); Takuya Hasegawa, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/945,293

(22) Filed: Nov. 27, 2007

(65) Prior Publication Data

US 2008/0132103 A1 Jun. 5, 2008

(30) Foreign Application Priority Data

Nov. 30, 2006 (JP) ..... 2006-323571

(51) Int. Cl.
*H01R 13/187* (2006.01)

(52) U.S. Cl. ..... 439/845; 439/852; 439/846

(58) Field of Classification Search ..... 439/845, 439/843, 846, 852, 839–842, 345
See application file for complete search history.

(56) References Cited

U.S. PATENT DOCUMENTS 4,880,401 A * 11/1989 Shima et al. ..... 439/746
5,601,458 A * 2/1997 Ohsumi et al. ..... 439/852
5,643,018 A * 7/1997 Sakai et al. ..... 439/852
5,964,604 A * 10/1999 Kashiyama et al. ..... 439/157
6,527,601 B2 * 3/2003 Chen ..... 439/852
6,761,597 B2 * 7/2004 Shimizu ..... 439/852
7,114,979 B1 * 10/2006 Lai ..... 439/346
7,374,465 B2 * 5/2008 Tanaka ..... 439/852
2001/0002350 A1 * 5/2001 Kashiyama et al. ..... 439/848
2002/0077001 A1 * 6/2002 Chen ..... 439/852
2002/0086590 A1 * 7/2002 Mitani et al. ..... 439/852
2002/0115331 A1 * 8/2002 Ho ..... 439/346
2003/0032342 A1 * 2/2003 Shimizu ..... 439/852

FOREIGN PATENT DOCUMENTS

JP 7-94225 A 4/1995

* cited by examiner

*Primary Examiner*—T C Patel
*Assistant Examiner*—Harshad C Patel
(74) *Attorney, Agent, or Firm*—Sughrue Mion, PLLC

(57) ABSTRACT

A female terminal includes a tubular portion which has a square tubular shape and receives a male terminal therein and a resilient member which is provided in the tubular portion so as to urge the male terminal toward an inner surface of the tubular portion. The resilient member includes a curved portion formed by a strip-like electrically-conductive metal sheet and a pair of mounting portions integrally formed respectively at widthwise-opposite side edges of the curved portion and extending away from each other. The tubular portion has a pair of side walls opposed to each other and has a pair of through windows provided on the side walls respectively, the pair of mounting portions being inserted in the pair of through windows respectively. At least part of each of the mounting portions located respectively in the through windows is greater in thickness than the other portion of each of the mounting portions.

1 Claim, 10 Drawing Sheets

FEMALE TERMINAL

BACKGROUND

This invention relates to a female terminal used for a wire harness or others.

FIGS. 5 and 6 show a female terminal 101 earlier proposed by the Applicant of the present Application (see, for example, JP-A-7-94225).

The female terminal 101 is formed from an electrically-conductive metal sheet through blanking, bending, etc. The female terminal 101 includes a wire connection portion 103 for connection to a wire, and an electrical contact portion 102 for connection to a mating male terminal. The wire connection portion 103 includes a bottom wall 131 for the placing of the wire thereon, a pair of first press-clamping piece portions 132 extending upwardly respectively from widthwise-opposite side edges of the bottom wall 131, and a pair of second press-clamping portions 133. The first press-clamping piece portions 132 are press-clamped (or crimped) to a conductor (core wire) of the wire to be electrically connected thereto. The second press-clamping piece portions 133 are press-clamped to a sheath of the wire, and therefore is mechanically connected to the wire.

The electrical contact portion 102 includes a tubular portion 120 formed into a square tubular shape and adapted to receive the male terminal therein, and a resilient piece 104 mounted within the tubular portion 120 so as to urge the male terminal toward an inner surface of the tubular portion 120. The tubular portion 120 includes a bottom wall 121 extending from the bottom wall 131, a pair of side walls 122 extending upwardly respectively from widthwise-opposite side edges of the bottom wall 121, and upper walls 123 extending respectively from the pair of side walls 122 and disposed in opposed relation to the bottom wall 121. Through windows 124 for mounting the resilient piece 104 are formed respectively through those end portions of the pair of side walls 122 disposed close to the bottom wall 121.

As shown in FIG. 7, the resilient piece 104 includes a curved portion 141 formed by a strip-like electrically-conductive metal sheet bent into a generally arch-shape, and a pair of mounting portions 140 formed respectively at widthwise-opposite side edges of the curved portion 141 at one longitudinal end thereof. Each of the pair of mounting portion 140 includes a strip-like connecting portion 142 extending from the one longitudinal end of the curved portion 141 to a longitudinally-central portion thereof, and a projecting portion 143 formed on a longitudinally-central portion of the connecting portion 142 and projecting therefrom in a direction away from the curved portion 141. The projecting portions 143 are inserted in the through windows 124, respectively.

This resilient piece 104 is mounted in the tubular portion 120 in a manner shown in FIGS. 8A to 8D. Namely, in the process of bending the side walls 122 during the formation of the tubular portion 120, the resilient piece 104 is located between the pair of side walls 122 as shown in FIG. 8A, and the resilient piece 104 is superposed on the bottom wall 121 as shown in FIG. 8B. At this time, the resilient piece 104 is superposed on the bottom wall 121 in such a manner that a convex surface of the curved portion 141 is directed toward the upper walls 123. Then, the projecting portions 143 are located respectively in the through windows 124, and the pair of side walls 122 are bent or moved toward each other as shown in FIGS. 8C and 8D. Thus, the female terminal 101 shown in FIGS. 5 and 6 is formed.

However, the above female terminal 101 has the following problem. This problem will be explained with reference to FIGS. 9 and 10.

Namely, in order that the resilient piece 104 can be mounted within the tubular portion 120, each through window 124 need to be formed into a size corresponding to the dimensions of the projecting portion 143. For example, in case the dimension of the projecting portion 143 in the direction of the width of the bottom wall 121 (that is, the amount S1 of engagement of the projecting portion 143 in the through window 124) is increased as shown in FIG. 9, the dimension of the through window 124 in a direction from the bottom wall 121 toward the upper wall 123 need to be increased, and this invites a problem that a large gap U1 is formed between an edge of the through window 124 and the projecting portion 143 in the direction of the thickness of the resilient piece 104. In FIGS. 9 and 10, T1 and T2 indicate a clearance provided in view of tolerances of the resilient piece 104 and the tubular portion 120.

Also, in case the dimension of the projecting portion 143 in the direction of the width of the bottom wall 121 (that is, the amount S2 of engagement of the projecting portion 143 in the through window 124) is reduced as shown in FIG. 10, a gap U2 formed between the edge of the through window 124 and the projecting portion 143 is reduced. However, this invites a problem that the projecting portion 143 is liable to be disengaged from the through window 124.

SUMMARY

Therefore, it is an object of this invention to provide a female terminal in which a resilient piece is prevented from being disengaged from a tubular portion, and also the shaking of the resilient piece is reduced.

In order to achieve the above object, according to the present invention, there is provided a female terminal comprising:

a tubular portion which has a square tubular shape and receives a male terminal therein; and a resilient member which is provided in the tubular portion so as to urge the male terminal toward an inner surface of the tubular portion, wherein the resilient member includes a curved portion formed by a strip-like electrically-conductive metal sheet and a pair of mounting portions integrally formed respectively at widthwise-opposite side edges of the curved portion and extending away from each other;

wherein the tubular portion has a pair of side walls opposed to each other and has a pair of through windows provided on the side walls respectively, the pair of mounting portions being inserted in the pair of through windows respectively; and wherein at least part of each of the mounting portions located respectively in the through windows is greater in thickness than the other portion of each of the mounting portions.

In the above configuration, the resilient member is formed such that at least part of each of the mounting portions located respectively in the through windows is greater in thickness than the other portion of each of the mounting portions. Therefore, even when the amount of engagement of each mounting portion in the through window is increased, a gap formed between an edge of the through window and the above larger-thickness portion of the mounting portion in the direction of the thickness of the resilient member can be reduced. Therefore, there can be obtained the female terminal in which the resilient member is prevented from being disengaged from the tubular portion, and besides the shaking of the resilient member can be reduced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Figure 1:
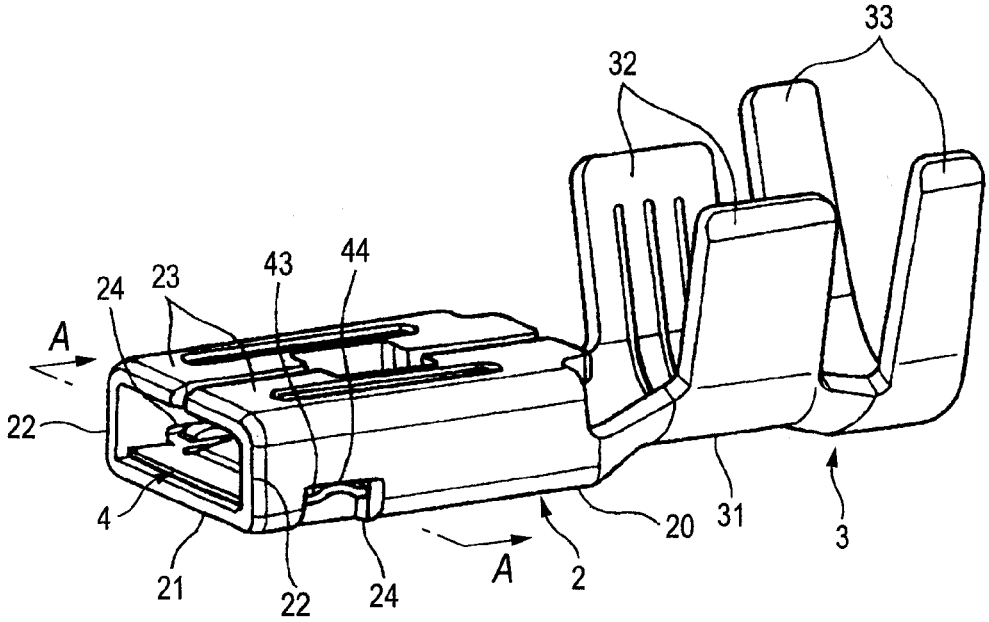
FIG. 1 is a perspective view of one preferred embodiment of a female terminal of the present invention.
Figure 2:
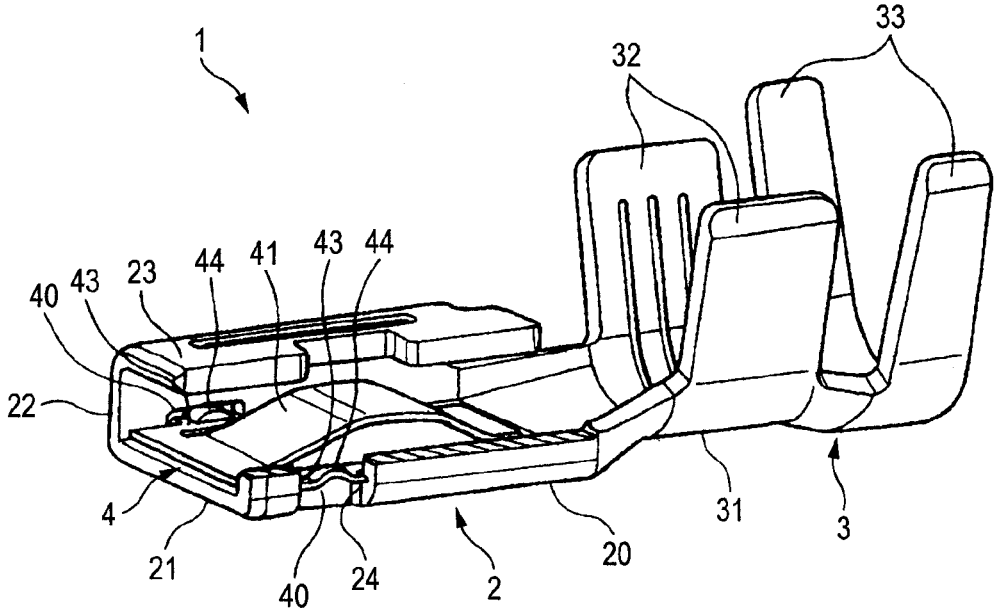
FIG. 2 is a partly-broken, perspective view of the female terminal of FIG. 1.

One preferred embodiment of a female terminal 1 of the present invention will now be described with reference to the drawings. The female terminal 1 shown in FIGS. 1 and 2 is formed from a sheet of electrically-conductive metal (such as copper, a copper alloy (examples of which include brass and beryllium copper), steel or stainless steel) through blanking, bending, etc. The female terminal 1 includes a wire connection portion 3 for connection to a wire, and an electrical contact portion 2 for connection to a male terminal formed into a bar-like shape.

The wire connection portion 3 includes a bottom wall 31 for the placing of the wire thereon, a pair of first press-clamping piece portions 32 extending upwardly respectively from widthwise-opposite side edges of the bottom wall 31, and a pair of second press-clamping portions 33. The first press-clamping piece portions 32 are press-clamped (or crimped) to a conductor (core wire) of the wire to be electrically connected thereto. The second press-clamping piece portions 33 are press-clamped to a sheath of the wire, and therefore is mechanically connected to the wire.

The electrical contact portion 2 includes a tubular portion 20 bent into a square tubular shape and adapted to receive the male terminal therein, and a resilient piece 4 mounted within the tubular portion 20 so as to urge the male terminal toward an inner surface of the tubular portion 20. The tubular portion 20 includes a bottom wall 21 extending from the bottom wall 31, a pair of side walls 22 extending upwardly respectively from widthwise-opposite side edges of the bottom wall 21, and a pair of upper walls 23 extending respectively from the pair of side walls 22 and disposed in opposed relation to the bottom wall 21. The pair of upper walls 23 are disposed in a common plane. A pair of through windows 24 for mounting the resilient piece 4 are formed respectively through those end portions (lower end portions) of the pair of side walls 22 disposed close to the bottom wall 21.

Figure 3:
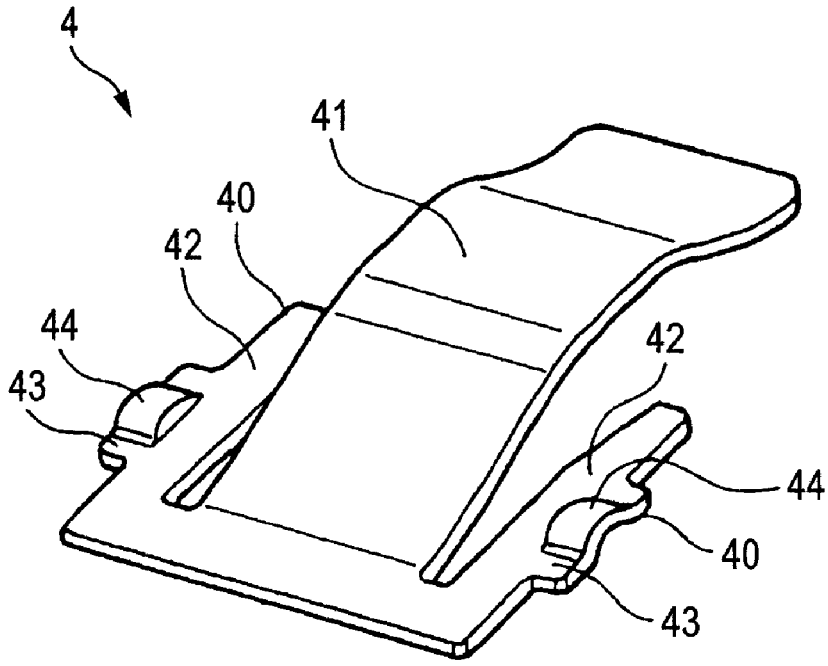
FIG. 3 is a perspective view of a resilient piece of the female terminal of FIG. 1.

The resilient piece 4 is made of a sheet of electrically-conductive metal (such as copper, a copper alloy (examples of which include brass and beryllium copper), steel or stainless steel). As shown in FIG. 3, the resilient piece 4 includes a strip-like curved portion 41 bent into a generally arch-shape, and a pair of mounting portions 40 integrally formed respectively at widthwise-opposite side edges of the curved portion 41 at one longitudinal end thereof. Each of the pair of mounting portion 40 includes a strip-like connecting portion 42 extending from the one longitudinal end of the curved portion 41 to a longitudinally-central portion thereof, and a projecting portion 43 formed on a longitudinally-central portion of the connecting portion 42 and projecting therefrom in a direction away from the curved portion 41. The projecting portions 43 are inserted in the through window 24, respectively.

Figure 4:
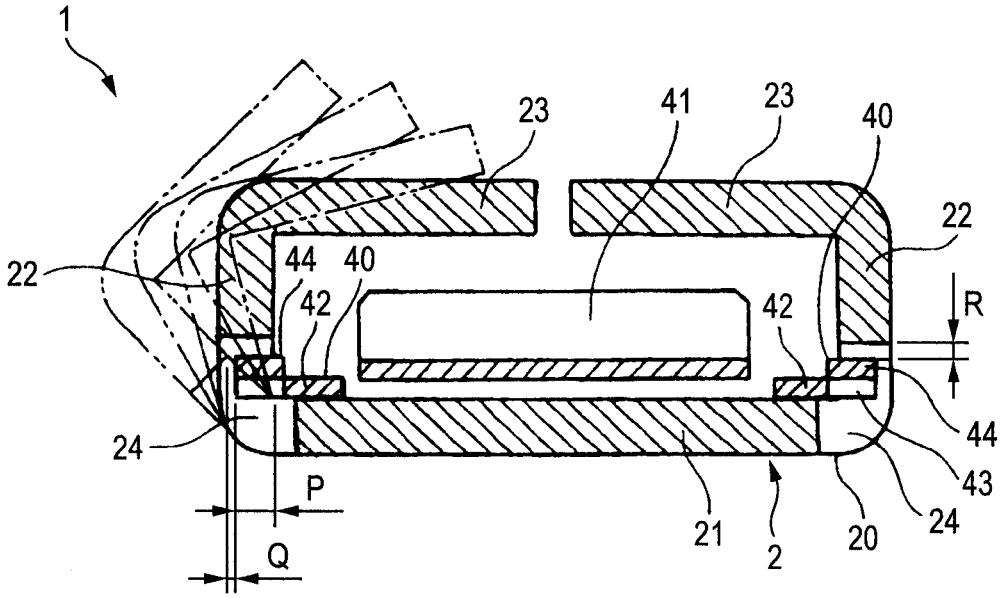
FIG. 4 is a cross-sectional view taken along the line A-A of FIG. 1.
Figure 5:
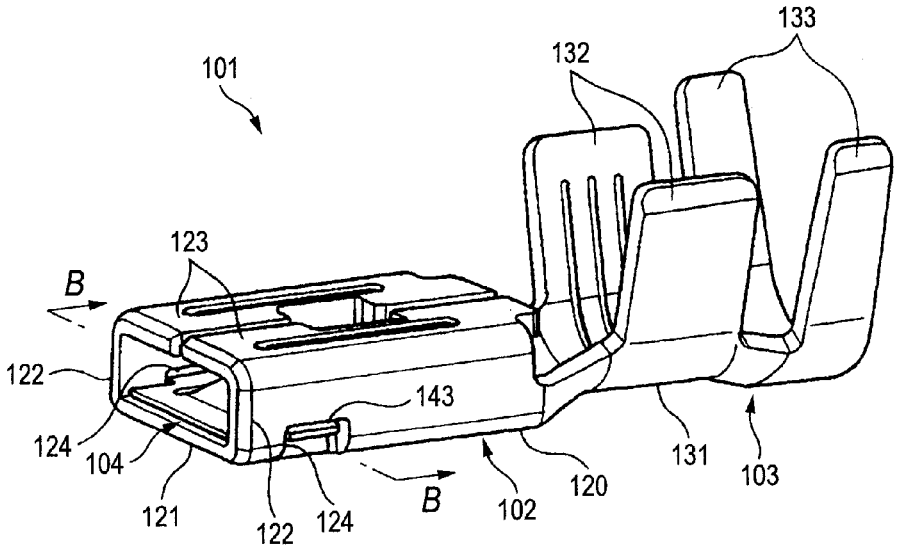
FIG. 5 PRIOR ART
FIG. 5 is a perspective view of a conventional female terminal.
Figure 6:
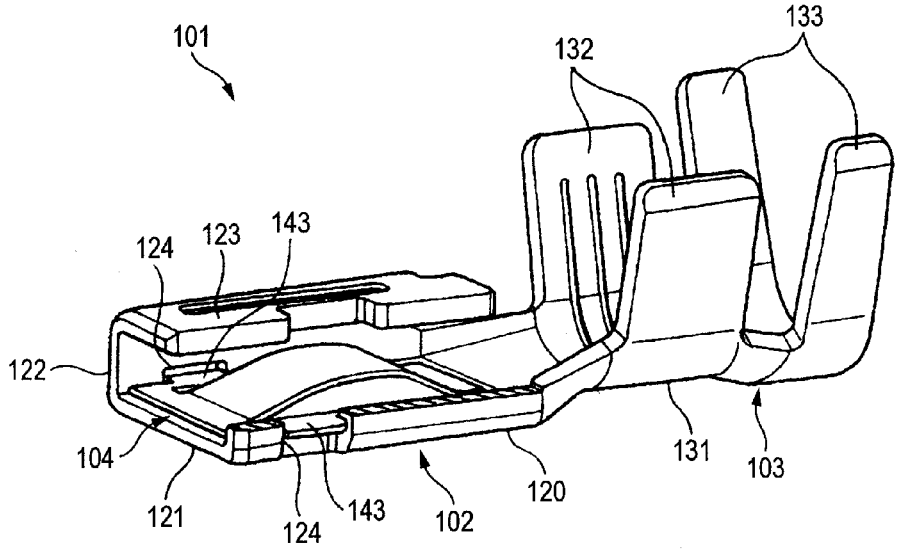
FIG. 6 PRIOR ART
FIG. 6 is a partly-broken, perspective view of the female terminal of FIG. 5.
Figure 7:
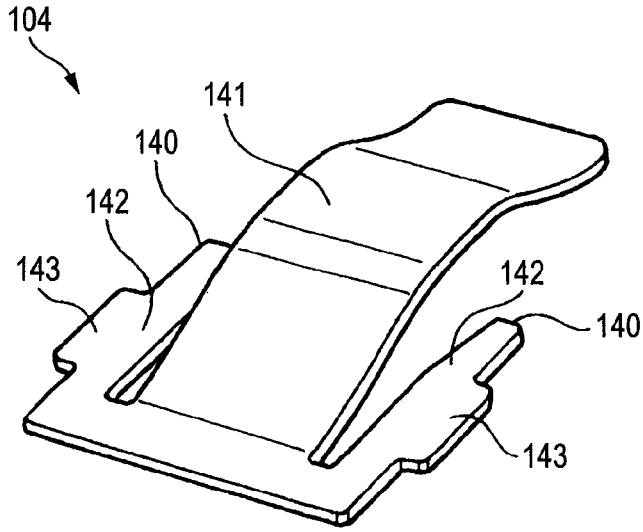
FIG. 7 PRIOR ART
FIG. 7 is a perspective view of a resilient piece of the female terminal of FIG. 5.
Figure 8A:
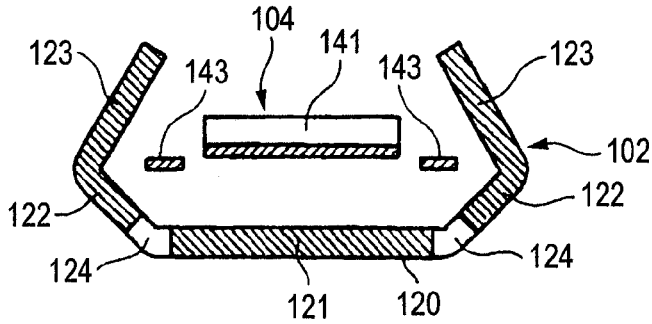
FIG. 8A PRIOR ART
FIGS. 8A to 8D are views explanatory of a method of assembling the female terminal of FIG. 5.
Figure 8B:
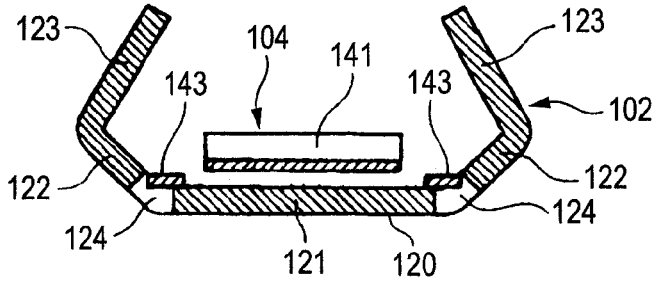
FIG. 8B PRIOR ART
Figure 8C:
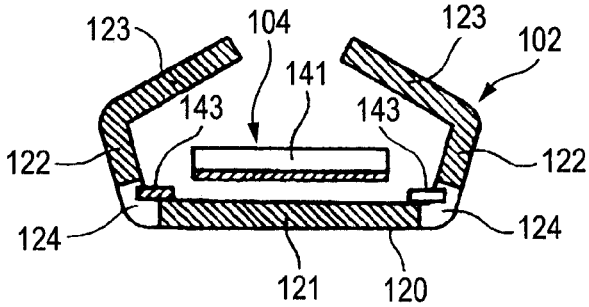
FIG. 8C PRIOR ART
Figure 8D:
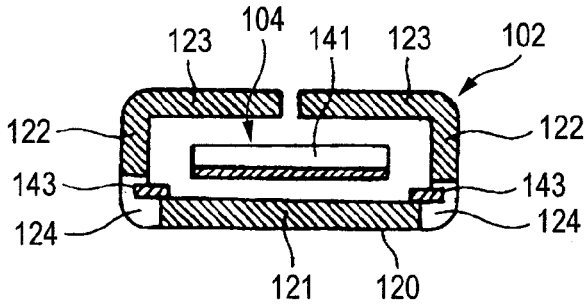
FIG. 8D PRIOR ART
Figure 9:
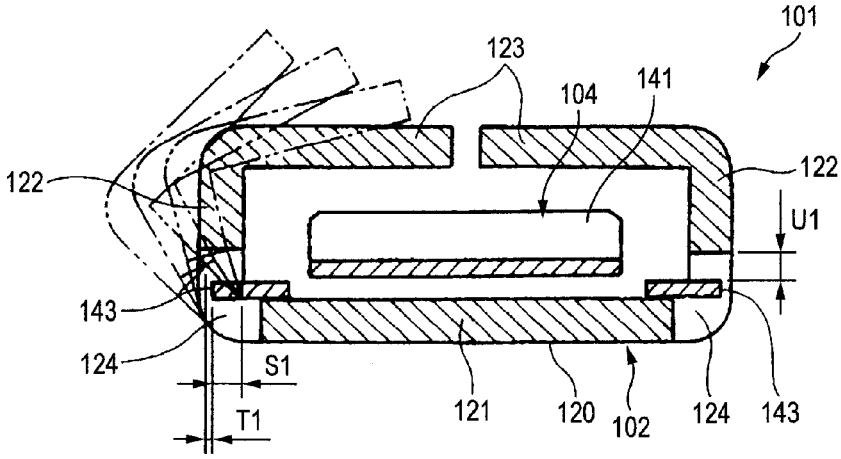
FIG. 9 PRIOR ART
FIG. 9 is a cross-sectional view taken along the line B-B of FIG. 5, explaining a problem with the conventional female terminal.
Figure 10:
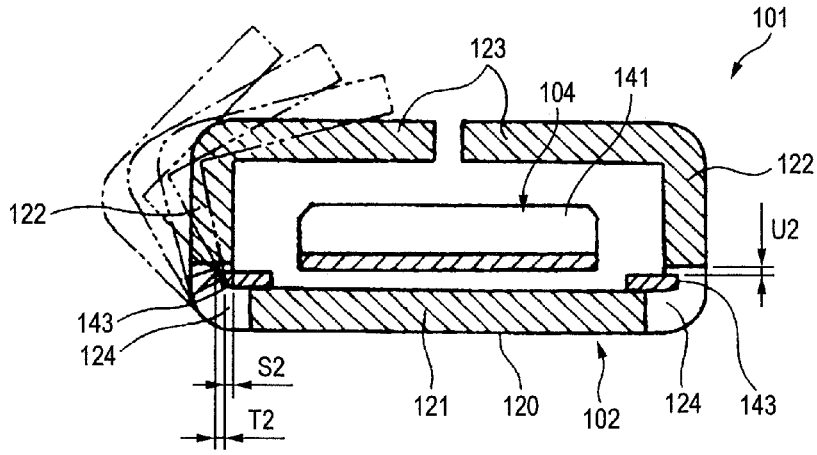
FIG. 10 PRIOR ART
FIG. 10 is a cross-sectional view explanatory of a problem with the conventional female terminal.

Further, a stamped-out portion (or bulged portion) 44 is formed on each projecting portion 43. This stamped-out portion 44 is formed by applying a stamping force to that side (surface) of the projecting portion 43 to be superposed on the base wall 21 (see FIG. 4), in a direction toward the opposite surface thereof which is to be opposed to the upper wall 23. Therefore, that portion of the mounting portion 40 at which the stamped-out portion 44 is formed is larger in thickness than the other portion of the mounting portion 40. Therefore, even when the amount P of engagement of the projecting portion 43 in the through window 24 is increased as shown in FIG. 4, a gap R formed between an edge of the through window 24 and the projecting portion 43 in a direction of the thickness of the resilient piece 4 can be reduced. In FIG. 4, Q indicates a clearance provided in view of tolerances of the resilient piece 4 and the tubular portion 20. The term "the thickness of that portion of the mounting portion 40 at which the stamped-out portion 44 is formed" means a dimension from an inner surface of the bottom wall 21 to that surface of the stamped-out portion 44 opposed to the upper wall 23. Namely, in the present specification, the term "the thickness of the mounting portion" means the dimension from the inner surface of the bottom wall 21 to that surface of the mounting portion 40 opposed to the upper wall 23 when the resilient piece 4 is mounted within the tubular portion 20.

For mounting the resilient piece 4 in the tubular portion 20, the resilient piece 4 is located between the pair of side walls 22 in the process of bending interconnecting portions (each interconnecting the side wall 22 and the bottom wall 21) during the formation of the tubular portion 20, and the resilient piece 4 is superposed on the bottom wall 21. At this time, the resilient piece 4 is superposed on the bottom wall 21 in such a manner that a convex surface of the curved portion 41 is directed toward the upper walls 23. Then, the projecting portions 43 are located respectively in the through windows 24, and the pair of side walls 22 are bent or moved toward each other. Thus, the female terminal 1 shown in FIGS. 1 and 2 is formed.

The female terminal 1 is connected at its wire connection portion 3 to the wire, and then is received in a connector housing (not shown). Then, the male terminal received in a mating connector housing is inserted into the tubular portion 20, and the resilient piece 4 urges this male terminal toward the upper walls 23.

In the resilient piece 4 of this embodiment, because of the formation of the stamped-out portion 44, at least part of each projecting portion 43 to be located in the through window 24 is larger in thickness than the other portion of the mounting portion 40, and therefore even when the amount of engagement of the projecting portion 43 in the through window 24 is increased, the gap R formed between the edge of the through window 24 and the projecting portion 43 in the direction of the thickness of the resilient piece 4 can be reduced. Therefore, there can be obtained the female terminal 1 in which the resilient piece 4 is prevented from being disengaged from the tubular portion 20, and besides the shaking of the resilient piece 4 can be reduced.

In the above embodiment, although the stamped-out portion (larger-thickness portion) 44 is formed at the projecting portion 43, such a larger-thickness portion may be formed by bending or folding a flat projecting portion 43 back on itself. In another modified form of the invention, a protruding member separate from a flat projecting portion 43 is adhesively bonded to this projecting portion 43.

The above embodiment merely shows a typical example of the present invention, and the present invention is not limited to the above embodiment. Namely, various modifications can be made without departing from the subject matter of the invention.

What is claimed is:

1. A female terminal comprising:

a tubular portion which has a square tubular shape and receives a male terminal therein; and a resilient member which is provided in the tubular portion so as to urge the male terminal toward an inner surface of the tubular portion, wherein the resilient member includes a curved portion formed by a strip-like electrically-conductive metal sheet and a pair of mounting portions integrally formed respectively at widthwise-opposite side edges of the curved portion and extending away from each other;

wherein the tubular portion has a pair of side walls opposed to each other and has a pair of through windows provided on the side walls respectively, the pair of mounting portions being inserted in the pair of through windows respectively; and wherein at least part of each of the mounting portions located respectively in the through windows is greater in thickness than the other portion of each of the mounting portions.

* * * * *